US010457474B2

(12) United States Patent
Graziano

(10) Patent No.: US 10,457,474 B2
(45) Date of Patent: Oct. 29, 2019

(54) INDIVIDUAL PILL DISPENSER

(71) Applicant: Thomas Graziano, Bayshore, NY (US)

(72) Inventor: Thomas Graziano, Bayshore, NY (US)

(73) Assignee: T Graziano Product Development LLC, Lindenhurst, NY (US)

( * ) Notice: Subject to any disclaimer, the term of this patent is extended or adjusted under 35 U.S.C. 154(b) by 0 days.

(21) Appl. No.: 15/379,837

(22) Filed: Dec. 15, 2016

(65) Prior Publication Data

US 2017/0210545 A1 Jul. 27, 2017

Related U.S. Application Data

(63) Continuation-in-part of application No. 15/006,778, filed on Jan. 26, 2016.

(51) Int. Cl.

| | |
|---|---|
| ***B65D 83/04*** | (2006.01) |
| ***A61J 1/03*** | (2006.01) |
| ***B65D 1/02*** | (2006.01) |
| ***B65D 41/16*** | (2006.01) |

(52) U.S. Cl.

CPC ..... *B65D 83/049* (2013.01); *A61J 1/03* (2013.01); *B65D 1/0246* (2013.01); *B65D 41/16* (2013.01); *B65D 83/0409* (2013.01)

(58) Field of Classification Search

CPC ..... A61J 1/03; B65D 41/16; B65D 83/049; B65D 83/0409; B65D 83/0427; B65D 2215/04

See application file for complete search history.

(56) References Cited

U.S. PATENT DOCUMENTS

| | | | | |
|---|---|---|---|---|
| 2,352,066 A | | 6/1944 | Apfelbaum | |
| 2,889,081 A | | 6/1959 | Spencer | |
| 3,027,000 A | | 3/1962 | Kantrow | |
| 3,245,589 A | | 4/1966 | Temliak | |
| 3,601,250 A | * | 8/1971 | Merila | B65D 83/0481 206/540 |
| 3,871,522 A | | 3/1975 | Feldman | |
| 3,889,847 A | | 6/1975 | Uroshevich et al. | |

(Continued)

FOREIGN PATENT DOCUMENTS

WO WO 2015145033 A1 * 10/2015 ..... B65D 83/0409

OTHER PUBLICATIONS

International Search Report issued in Counterpart PCT Application No. PCT/US2017/041699.

(Continued)

*Primary Examiner* — Gene O Crawford
*Assistant Examiner* — Kelvin L Randall, Jr.
(74) *Attorney, Agent, or Firm* — Da Vinci's Notebook, LLC

(57) ABSTRACT

A pill dispenser that includes a container and a cap having a pill dispensing chamber that is configured to receive a single pill. The container has a neck extending from the upper segment of the container walls that has an aperture made therethrough. The cap, which also has an aperture in its annular edge is rotatably mounted to the neck of the container. Upon inverting the pill dispenser, a pill will be received in the dispensing chamber. Thereafter, the cap is rotated a sufficient distance to cause the aperture on the cap to align with the aperture in the neck—thereby forming a passage through which a single pill is dispensed.

4 Claims, 16 Drawing Sheets

(56) References Cited

U.S. PATENT DOCUMENTS

| | | | | |
|---|---|---|---|---|
| 4,228,920 | A * | 10/1980 | Burton | B65D 83/0409 221/265 |
| 4,234,093 | A | 11/1980 | Tyson | |
| 4,432,300 | A | 2/1984 | Lyss | |
| 4,520,921 | A | 6/1985 | Vissing | |
| 4,971,203 | A | 11/1990 | Weinstein | |
| 5,520,307 | A * | 5/1996 | Miller | G07F 11/44 206/459.5 |
| 5,749,496 | A * | 5/1998 | DeJonge, Sr. | B65D 47/242 215/216 |
| D458,837 | S * | 6/2002 | Cragie | D3/203.2 |
| 6,966,468 | B2 * | 11/2005 | McKay | B65D 47/263 220/253 |
| 8,033,422 | B2 * | 10/2011 | Estrada | B65D 50/04 221/154 |
| 2008/0217355 | A1 | 9/2008 | Kramer et al. | |
| 2010/0147867 | A1 | 6/2010 | Villegas Estrada | |
| 2011/0011883 | A1 * | 1/2011 | Nakkouri | B65D 47/265 221/206 |
| 2013/0256330 | A1 * | 10/2013 | Wang | B65D 83/0409 221/1 |
| 2015/0021349 | A1 | 1/2015 | Sanders | |
| 2015/0151898 | A1 | 6/2015 | Desset-Brethes et al. | |
| 2017/0107045 | A1 * | 4/2017 | Brosse | B65D 83/0409 |

OTHER PUBLICATIONS

Written Opinion issued in Counterpart PCT Application No. PCT/US2017/041699.

* cited by examiner

INDIVIDUAL PILL DISPENSER

RELATED APPLICATIONS

This Application is a Continuation-In-Part of pending U.S. application Ser. No. 15/006,778 filed on Jan. 26, 2016, the contents of which are incorporated by reference herein.

FIELD

The present invention generally relates to a dispenser for pills. In embodiments, the present invention is directed to a dispenser that may contain multiple pills, and is configured to dispense a single pill at a time.

SUMMARY

In the modern age of healthcare, pills, for example, medications and nutritional supplements, are widely available and are in consistent general use. Such items are often packaged in bulk in a container from which one or more units of medication or supplement can be dispensed or withdrawn, for example, to be ingested orally by a user.

However, Applicant has discovered a need for improving conventional container/dispensers. For example, Applicant has discovered that users, particular users with challenges to manual dexterity, may desire an aid to dispense a single pill of medication or supplement so as to avoid spillage or waste. Applicant has also discovered that such users may desire a single-pill dispenser that incorporates a safety feature to provide for selective opening by a user.

According to an exemplary embodiment of the present invention, a dispenser apparatus is disclosed, comprising: a container comprising: an at least partially enclosed wall that defines an interior cavity to retain a plurality of pills therein; the at least partially enclosed wall terminates at a neck, the neck includes a lock at least partially protruding therefrom, wherein the neck aperture has a size that is as large or larger than a pill of the plurality of pills; and a cap comprising: an interior recess such that the cap receives and rotationally engages the neck of the container, the cap defines a cap aperture that is rotatably alignable with the neck aperture, wherein when the cap aperture and the neck aperture are aligned, a passage between the interior cavity of the container and an outside environment is provided so that a pill may pass therethrough.

In embodiments, the neck aperture is circular.

In embodiments, the neck aperture is ovular.

In embodiments, a channel extends along an interior surface of the cap away from the cap aperture and is configured to at least partially receive the lock.

In embodiments, when the cap aperture is rotationally aligned with the lock, at least a portion of the lock protrudes into the cap aperture to inhibit rotational movement of the cap.

In embodiments, the neck and the cap are configured to interengage one another.

In embodiments, the cap comprises an interior channel configured to receive at least a portion of the neck.

In embodiments, the neck comprises a bead extending therefrom and at least partially circumferentially extending around the neck, the bead configured to interengage an interior portion of the cap.

In embodiments, the cap comprises a sweeper mechanism that extends into an interior portion of the neck of the container.

In embodiments, the sweeper mechanism is positioned circumferentially in front of the cap aperture in a direction of rotation of the cap.

According to an exemplary embodiment of the present invention, a method of dispensing a pill is disclosed, comprising: providing a dispenser apparatus that comprises: a container comprising an interior cavity and a neck having a neck aperture therealong; a cap configured to engage the neck of the container and having a cap aperture that is rotationally alignable with the neck aperture and a sweeper mechanism extending into an interior portion of the neck; inverting the dispenser apparatus so that a plurality of pills disposed in the interior cavity are moved toward the cap; rotating the cap about the neck so that the sweeper mechanism moves one or more pills of the plurality of pills away from the neck aperture; and rotating the cap about the neck so that the cap aperture rotationally aligns with the neck aperture.

In embodiments, the neck aperture is circular.

In embodiments, the neck aperture is ovular.

In embodiments, the container further comprises a lock at least partially protruding from the neck, and wherein the cap aperture is rotatably alignable with the lock.

In embodiments, the method further comprises the step of disengaging the cap aperture from the lock.

In embodiments, the step of inverting the dispenser apparatus comprises tilting the dispenser apparatus an angle of 90 degrees or greater with respect to an upright position.

In embodiments, the sweeper mechanism is positioned circumferentially in front of the cap aperture in a direction of rotation of the cap.

According to an exemplary embodiment of the present invention, a method of dispensing a pill is disclosed, comprising: providing a dispenser apparatus that comprises: a container comprising an interior cavity and a neck having a neck aperture therealong; a cap configured to engage the neck of the container and having a cap aperture that is rotationally alignable with the neck aperture; inverting the dispenser apparatus so that a plurality of pills disposed in the interior cavity are moved toward the cap; shaking the dispenser so that one or more pills of the plurality of pills are displaced away from the neck aperture; and rotating the cap about the neck so that the cap aperture rotationally aligns with the neck aperture.

In embodiments, the neck aperture is circular.

In embodiments, the neck aperture is ovular.

According to an exemplary embodiment of the present invention, a dispenser apparatus is disclosed, comprising a container and a cap having a pill dispensing chamber that is configured to receive a single pill. The container's neck and the annular edge of the cap each have an aperture that become aligned when the cap is rotated a sufficient distance. A pill may be dispensed from the dispensing chamber through the aligned apertures.

BRIEF DESCRIPTION OF THE DRAWINGS

Various exemplary embodiments of this invention will be described in detail, with reference to the following figures, wherein.

DETAILED DESCRIPTION

Figure 1A:
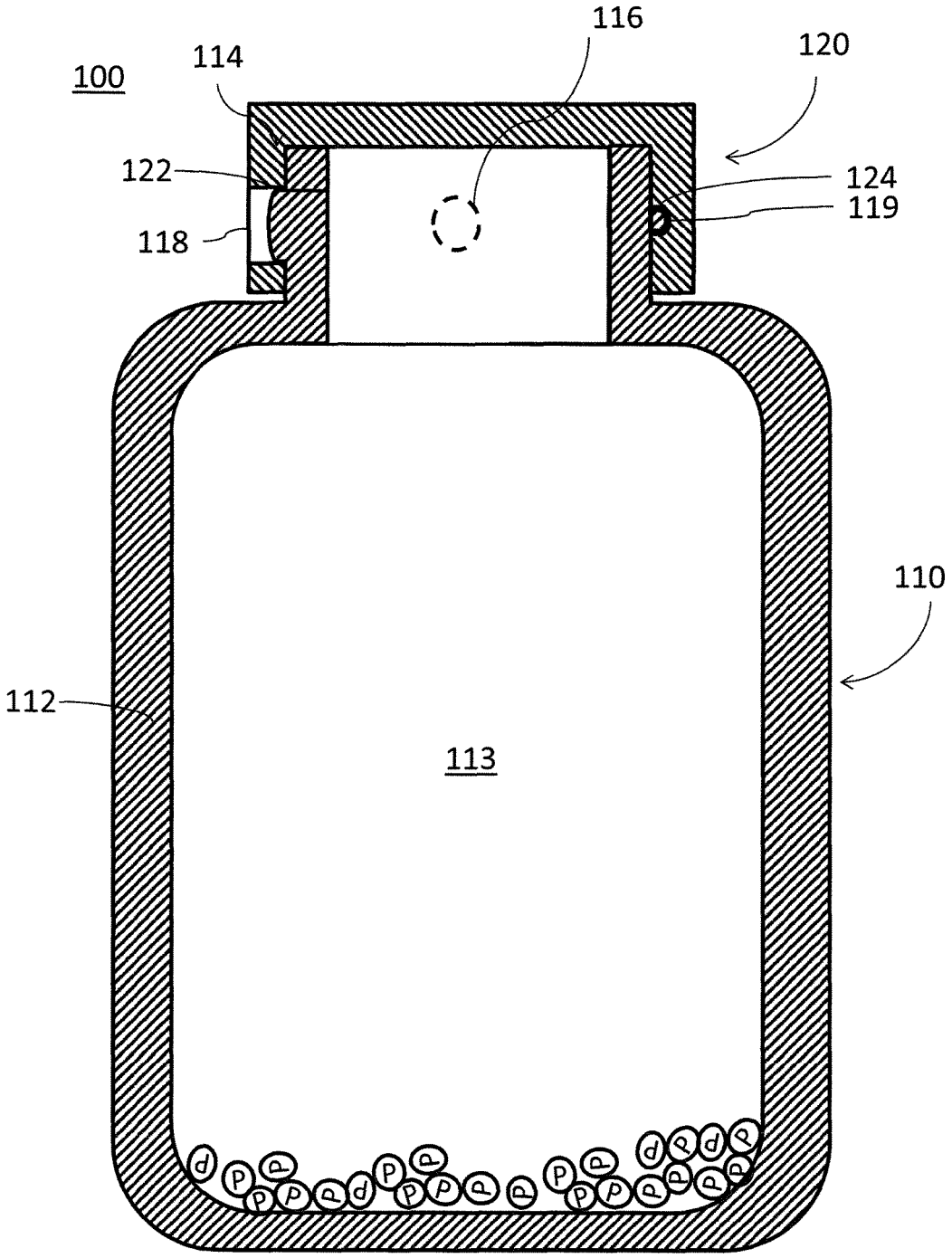
FIG. 1A is a first sequential cross-sectional view of a dispenser apparatus according to an exemplary embodiment of the present invention.

The present invention generally relates to a dispenser for pills. In embodiments, the present invention is directed to a dispenser that may contain multiple pills, and is configured to dispense one pill at a time.

The headings used herein are for organizational purposes only and are not meant to be used to limit the scope of the description or the claims. As used throughout this application, the words "may" and "can" are used in a permissive sense (i.e., meaning having the potential to), rather than the mandatory sense (i.e., meaning must). Similarly, the words "include," "including," and "includes" mean including but not limited to. To facilitate understanding, like reference numerals have been used, where possible, to designate like elements common to the figures.

With reference to FIG. 1A, a dispenser apparatus according to an exemplary embodiment of the present invention is generally designated 100. Dispenser apparatus 100 includes a container 110 and a cap 120 that movably engages a portion of the container 110, as described further herein.

Container 110 includes a wall 112 that defines an interior cavity 113. As shown, wall 112 may be arranged in an at least partially enclosed configuration, for example a cylindrical configuration with an open end. In this regard, objects deposited into interior cavity 113 can be maintained therein until dispenser apparatus 100 is manipulated by a user in a manner to allow the exit of the one or more objects, such as pills P, which may be circular or spherical units of medication or supplements. As described herein, pills P may have a different configuration.

The wall 112 of container 110 may taper to a neck 114 toward a top end of container 110. In this regard, neck 114 may have a generally smaller diameter than the remainder of container 110. As described further herein, neck 114 and cap 120 may be configured for interengagement, for example, via press fit, snap fit, or threadable engagement, to name a few. In embodiments, cap 120 may be configured to interengage a different portion of container 110. Neck 114 of container 110 also includes an aperture 116 through which a pill P can exit container 110. In this regard, aperture 116 is at least the same size as a pill P disposed within container 110 in at least one orientation. In embodiments, aperture 116 may be sized larger than a pill P disposed within container 110.

A lock 118 may also be disposed along a portion of neck 114 of container 110. Lock 118 may include a protruding portion such as a button or dome. In embodiments, lock 118 may be supported on a stem, for example, a perforated portion or slitted portion of neck 114. Lock 118 may be at least partially deformable, e.g., collapsible or flexible, so that lock 118 may be pressed inwardly, e.g., bows inwardly to protrude at least partially through neck 114 at least partially into interior cavity 113, such that lock 118 is flush with neck 114 or recessed therein. In embodiments, lock 118 may be configured to substantially maintain its shape, for example, so that a predetermined amount of rotational force exerted on cap 120 causes a camming-type action over lock 118. In embodiments, a different locking mechanism may be used. Lock 118 may maintain cap 120 in engagement and in a substantially rotationally stationary position with respect to container 110. In this regard, lock 118 may provide for selective opening of dispenser apparatus 100 and/or may provide a safety measure against, for example, accidental or inadvertent opening of dispenser apparatus 100.

Still referring to FIG. 1A, a bead 119 may be disposed at least partially around neck 114, and, as described further herein, may be positioned to engage a portion of cap 120. Bead 119 may be a protruding portion of neck 114, and may be disposed around neck 114 at the same or a similar vertical position as lock 118. Accordingly, lock 118 may be circumferentially positioned between sections of bead 119 along neck 114. In embodiments, bead 119 may have one or more additional discontinuities along neck 114. Bead 119 may be formed for example, as an integral portion of neck 114, e.g. a molded portion, or may be a separate element attached to neck 114 such as a sealing ring. Cap 120 may snap over bead 119 so that cap 120 is maintained on container 110.

Figure 6:
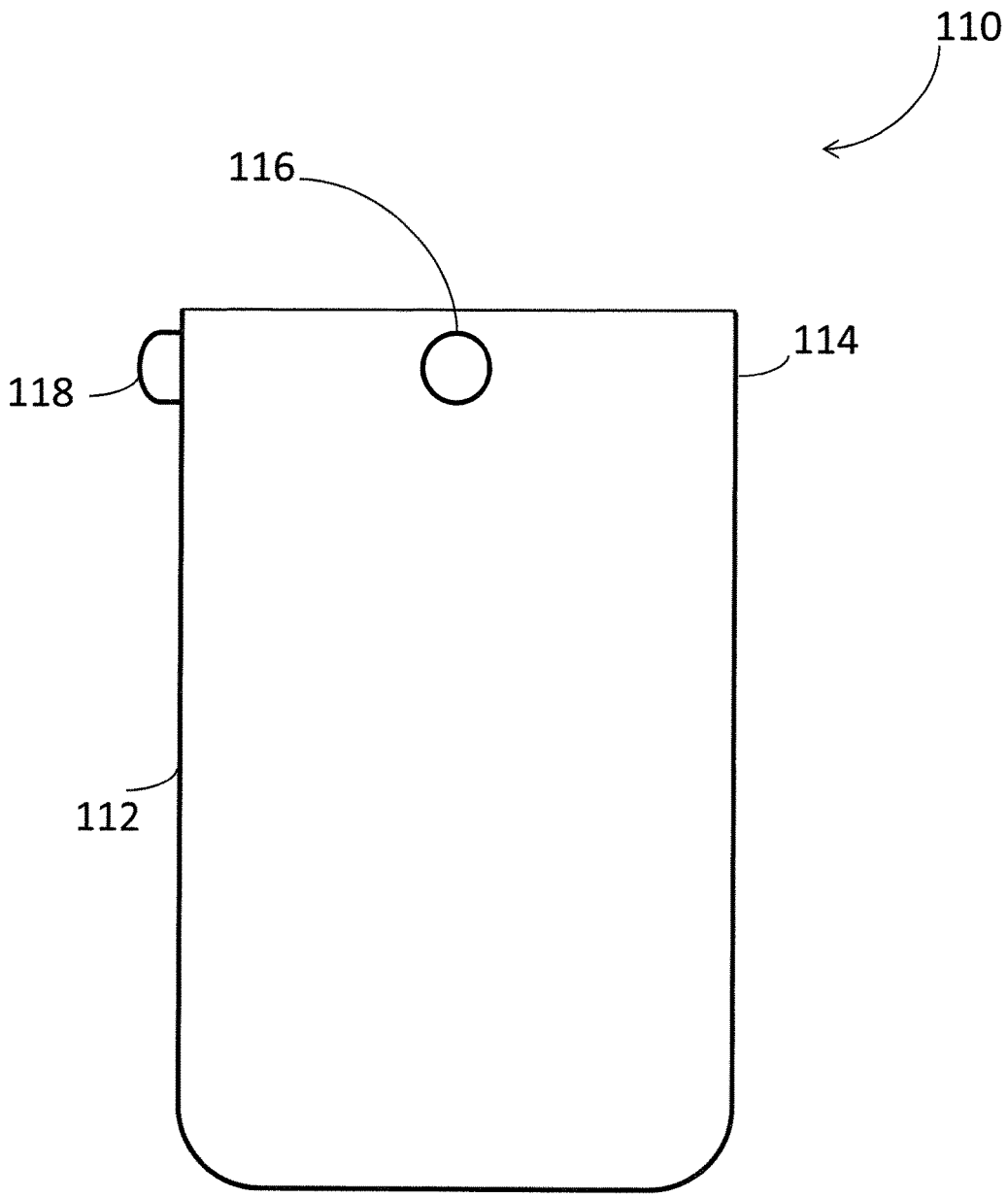
FIG. 6. is a front view of a container of a dispenser apparatus according to an exemplary embodiment of the present invention.

Referring momentarily to FIG. 6, in an exemplary embodiment, container 110 may have a wall 112 that terminates at a neck 114 that is a substantially similar diameter as that of the wall 112. In this regard, container 110 has a generally tubular configuration. Aperture 116, lock 118, and bead 119 may be disposed around the neck 114 as described above in this configuration.

Referring again to FIG. 1A, cap 120 may be a circular member that defines an opening and an interior recess for receiving a portion of neck 114 of container 110. In this regard, cap 120 may be complementary to the configuration of neck 114. Cap 120 includes an aperture 122 configured to receive at least a portion of lock 118 when aperture 122 is aligned therewith. In this regard, when dispenser apparatus 100 is in a closed configuration, lock 118 may protrude into aperture 122 such that lock 118 inhibits circumferential movement of cap 120 about neck 114 of container 110, as described further herein. The relative dimensions, e.g., tolerance, between cap 120 and container 110 may determine an amount of rotational force required to rotate cap 120 about neck 114 in addition to the presence of lock 118 As described above, a predetermined amount of force may cause the sides of cap 120 adjacent aperture 122 to cam over lock 118 so that cap 120 moves to an unlocked position.

Cap 120 may also include an interior channel 124 extending at least partially around an interior surface of cap 120 and positioned at a vertical level with lock 118 and/or bead 119. In this regard, cap 120 may be configured such that lock 118 abuts and/or partially enters channel 124 when dispensing apparatus 100 is in an open configuration. Additionally, one or more portions of bead 119 may be disposed within channel 124 in an open configuration of dispensing apparatus 100. As shown, bead 119 may have smaller dimensions than lock 118 so that bead 119 does not present an obstacle to rotation of cap 120 about neck 114, but the position of bead 119 within the channel 124 of cap 120 may inhibit vertical separation of cap 120 from container 110.

Channel 124 may permit substantially uninhibited rotation of cap 120 relative to container 110 along a selected circumferential distance of cap 120. In this regard, channel 124 may be dimensioned and/or positioned to permit a predetermined degree of rotational movement about neck 114. For example, channel 124 may extend fully around cap 120, or may extend partially around cap 120 with a terminus that forms or includes a stop to inhibit further rotation, e.g., so that cap 120 can only be turned a quarter turn, half turn, or other fractional turn relative to container 110.

Aperture 122 may also have at least the same dimensions as a largest cross-sectional area of pills P disposed within interior cavity 113 of container 110, e.g., aperture 122 may have similar dimensions to aperture 116 on neck 114 of container 110. Aperture 122 may be positioned on cap 120 such that aperture 122 on the cap 120 may be aligned with aperture 116 on neck 114 by rotating cap 120 about neck 114, as described further herein.

Cap 120 may also include a sweep mechanism 126 that is disposed adjacent at least one side of aperture 122. Sweep mechanism 126 may be an interior protrusion of cap 120, for example, from a top interior surface of cap 120, that is disposed circumferentially adjacent aperture 122 and, upon coupling with container 110, is disposed circumferentially adjacent aperture 116 on neck 114 of container 110. In this regard, sweep mechanism 126 may be integrally formed, e.g., molded, with the remainder of cap 120. As shown, sweep mechanism 126 may extend substantially along a vertical height of cap 120. In embodiments, sweep mechanism 126 may be integrally formed during fabrication of cap 120, or may be coupled with the remainder of cap 120, for example, through adhesion, welding, or interference fit. Sweep mechanism 126 may be interiorly spaced from an outer wall of cap 120 at least a distance sufficient to accommodate neck 114 upon coupling of container 110 and cap 120. Sweep mechanism 126 is configured to displace pills P in excess of a single pill P intended for dispensation upon rotational approach with aperture 122, as described further herein, so that optimally only a single pill is disposed at a time.

Figure 1B:
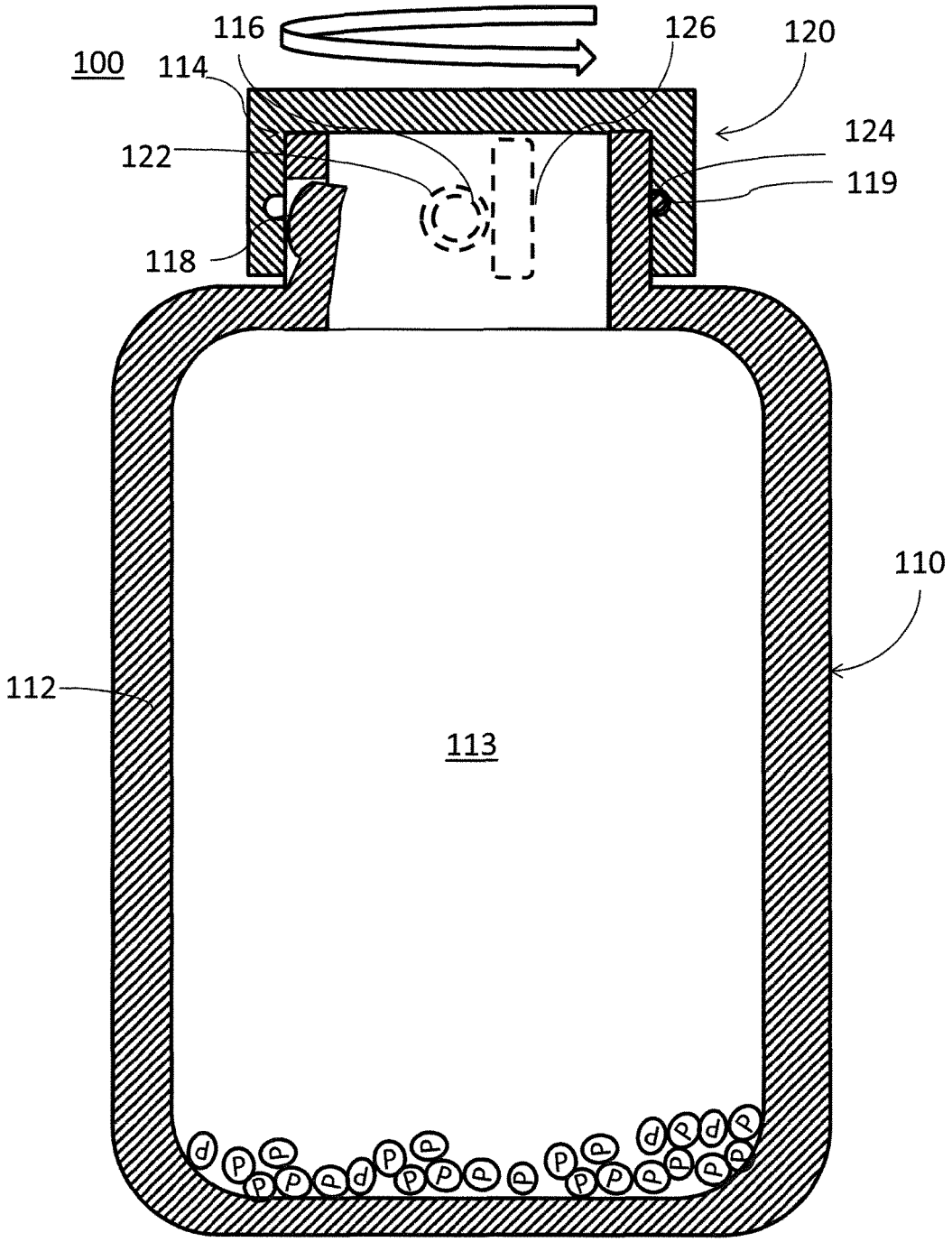
FIG. 1B is a second sequential cross-sectional view of the dispenser apparatus of FIG. 1A.
Figure 2:
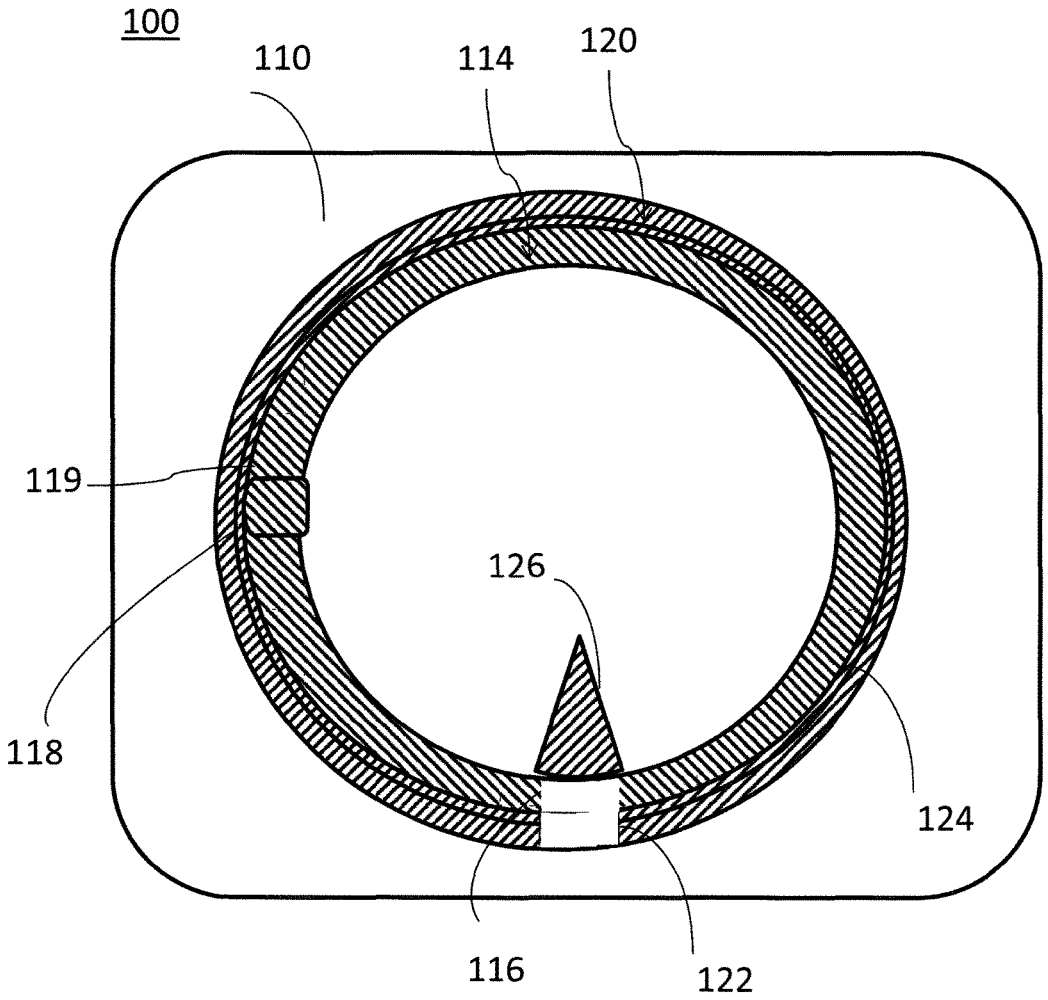
FIG. 2 is a partial cross-sectional view of the dispenser apparatus of FIG. 1A looking in a downward direction.

Still referring to FIG. 1A, and turning additionally to FIG. 1B and FIG. 2, operation of cap 120 will be described. With dispenser apparatus 100 in a locked position, e.g., with aperture 122 of cap 120 aligned with lock 118 such that a portion thereof protrudes from neck 114 into aperture 122 (shown best in FIG. 1A), a user may rotate cap 120 such that the edges of aperture 122 cam over lock 118 or otherwise disengage lock 118 from aperture 122. At this point, a user may rotate cap 120, e.g., twist, cap 120 about the neck 114 of container 110. It will be understood that dispenser apparatus 100 may be locked by reversing the steps described above, e.g., cap 120 may be rotated about the neck 114 such that aperture 122 aligns with lock 118 to allow the lock 118 to engage aperture 122. This may occur through a camming-type action in which the surface edges of cap 120 that define aperture 122 slide over a surface of the lock 118 such that lock 118 snaps or clicks into position within aperture 122.

Once dispenser apparatus 100 has been unlocked in the manner described above, cap 120 may be rotated such that aperture 122 aligns with aperture 116 on neck 114. With aperture 116 and aperture 122 aligned, a passage between the interior recess 113 of container 110 and an exterior environment is provided. Accordingly, a user may invert, shake, and/or otherwise manipulate dispenser apparatus 100 such that a pill disposed therein moves toward and travels through apertures 116, 122, e.g., in a dispensing operation.

However, in instances in which multiple pills P are disposed within dispenser apparatus 100, more than one pill P may approach apertures 116, 122 upon inversion of dispenser apparatus 100 such that multiple pills P may interfere with one another's exit through apertures 116, 122. Accordingly, a method of using dispenser apparatus 100 involving sweep mechanism 126 is provided herein.

Figure 3A:
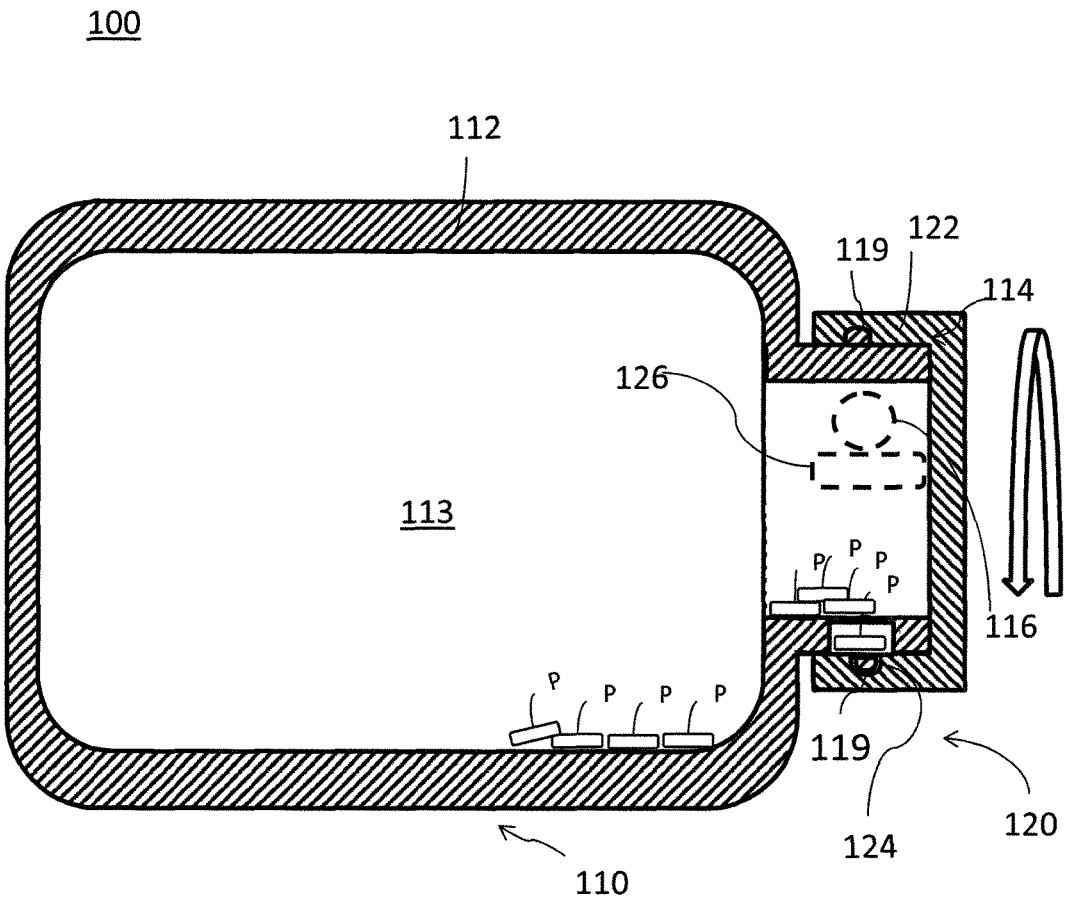
FIG. 3A is a first sequential cross-sectional view of the dispenser apparatus of FIG. 1A.
Figure 3B:
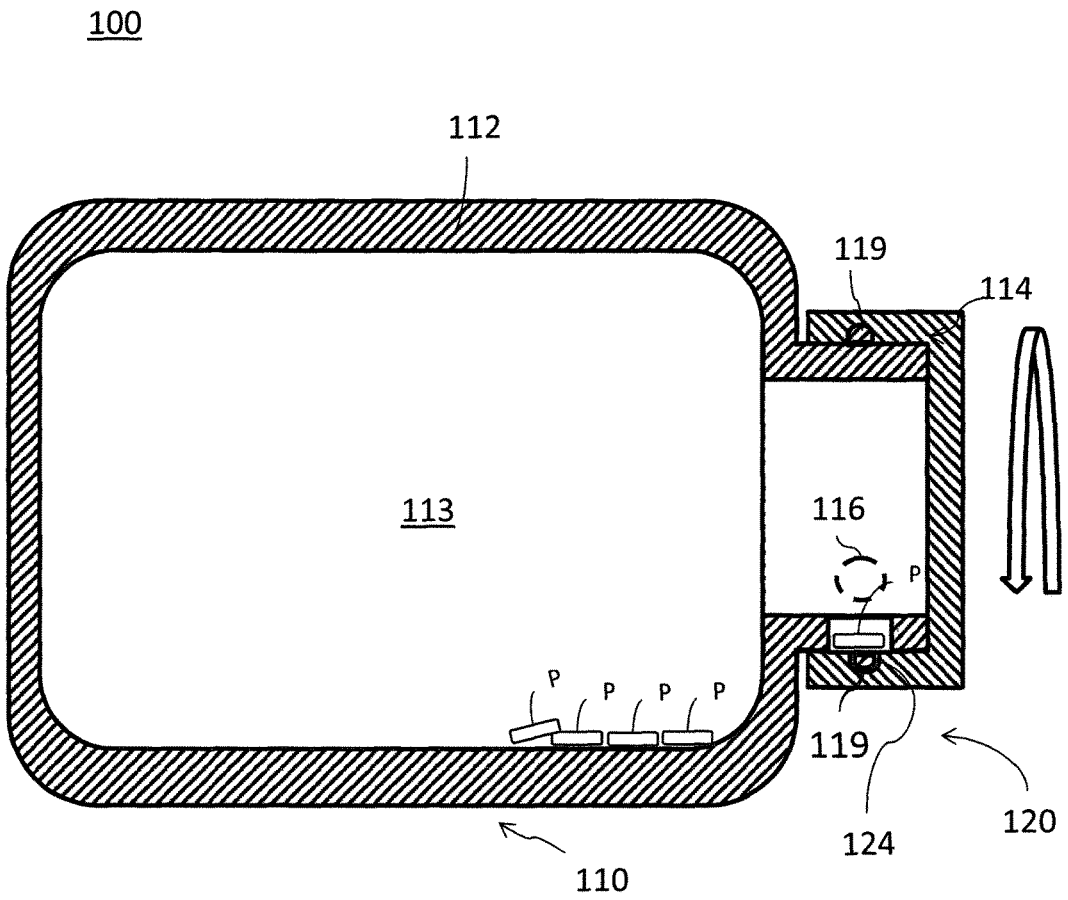
FIG. 3B is a second sequential cross-sectional view of the dispenser apparatus of FIG. 1A.
Figure 3C:
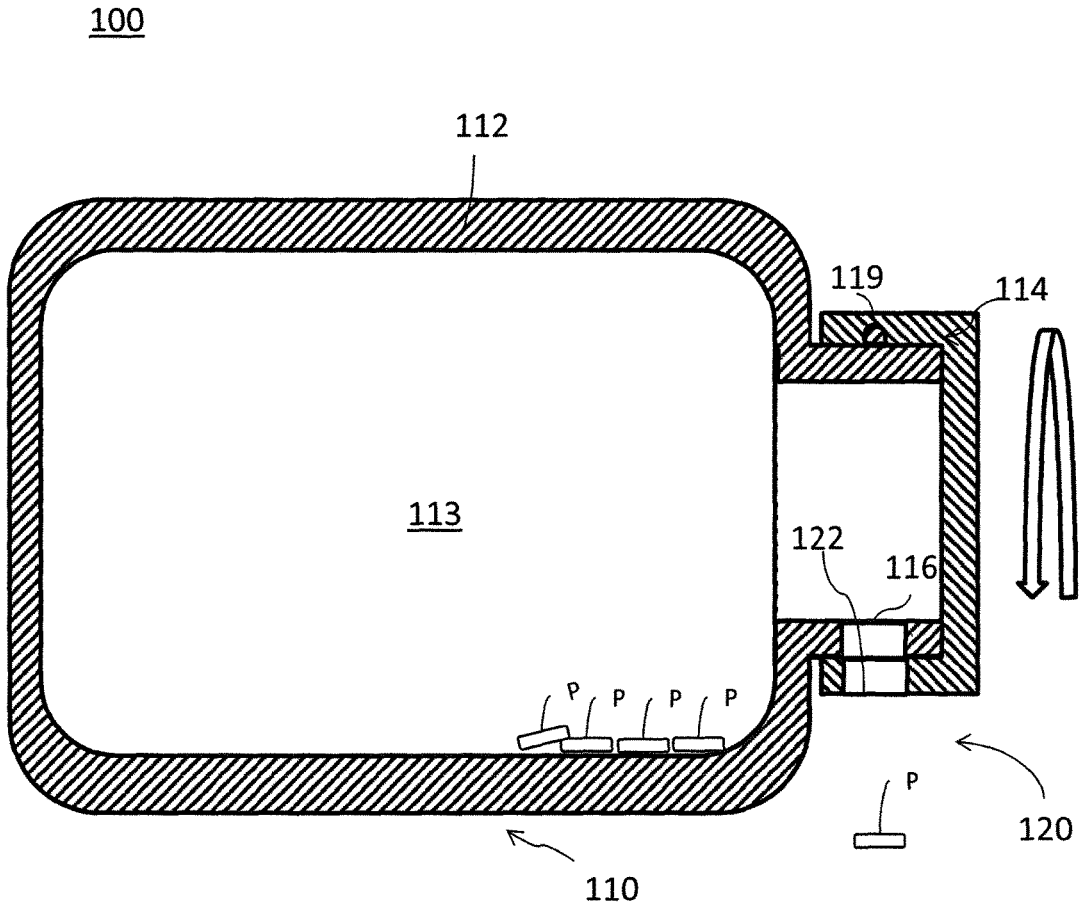
FIG. 3C is a third sequential cross-sectional view of the dispenser apparatus of FIG. 1A.
Figure 4:
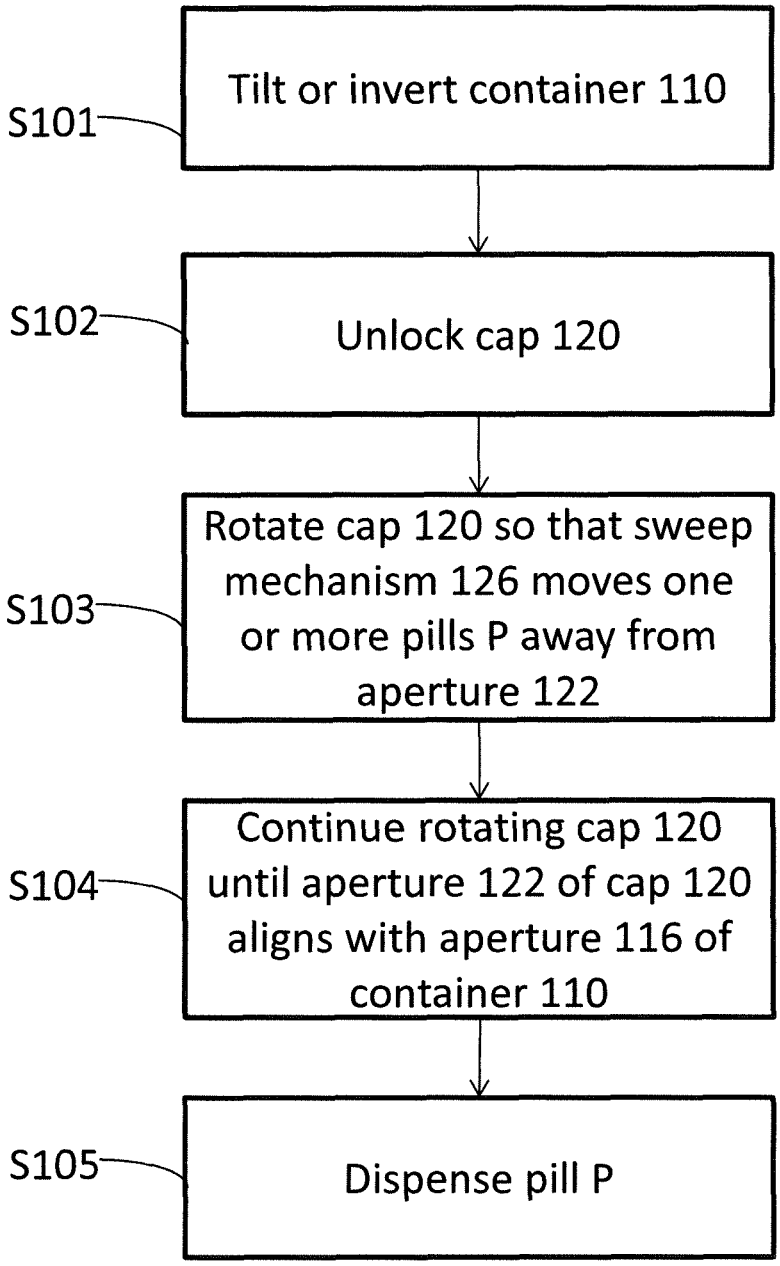
FIG. 4 is a flow chart directed to a method of operation of the dispenser apparatus of FIG. 1A according to an exemplary embodiment of the present invention.

With reference to FIGS. 3A, 3B, and 3C, and with additional reference to FIG. 4, a method of using dispenser apparatus 100 to ensure the orderly and singular dispensing of a single pill P at a time will be described. FIGS. 3A-3C are shown from a side orientation with respect to FIGS. 1A and 1B described above.

In a step S101, a user may grasp dispenser apparatus 100 containing multiple pills P and invert, e.g., tilt or turn to an angle, for example, an angle equal to or greater than 90° relative to an upright position, dispenser apparatus 100 as shown, e.g., by grasping and tilting or turning container 110. Upon inversion of dispenser apparatus 100, pills P will approach the neck 114 of container 110 and accumulate therein, stopped from further movement by the presence of cap 120 over the neck 114.

In a step S102, the user may grasp cap 120 and unlock cap 120 so that cap 120 can be rotated about neck 114 of container 110. As described above, cap 120 and container 110 may be configured such that a user can disengage lock 118 from aperture 122 by exerting a predetermined amount of rotational force on cap 120 so that the edges of cap 120 adjacent aperture 122 cam over lock 118 to permit further rotation of cap 120. The arrangement of cap 120 and container 110 may be selected such that a user with limited manual dexterity or strength, for example, a recovering stroke victim or arthritis patient, may be able to unlock cap 120 in this fashion with, for example, a loose grip on container 110 with one hand and a loose grip on cap 120 with the other hand. Such an arrangement provides for a selective opening of dispenser apparatus 100 by virtue of the lock 118, but also facilitates ease of access by populations with limited manual dexterity or strength.

In a step S103, the user may further rotate cap 120 such that sweep mechanism 126 of cap 120 approaches aperture 116 along the interior of neck 114 of container 110. In this regard, sweep mechanism 126 causes one or more pills P to be pushed past aperture 116 along neck 114 of container 110 as the aperture 122 of cap 120 approaches alignment with aperture 116 ahead of aperture 122 of cap 120. As described herein one or both of apertures 116, 122 may be dimensioned, e.g., have a thickness, such that a single pill P may become at least partially recessed therein during the aforementioned sweeping action of sweep mechanism 126 such that at least one pill P is not swept forward with the rotation of cap 120. In embodiments, for example, embodiments in which a sweep mechanism may not be present, a user may gently shake or otherwise disturb container 110 so that a plurality of pills P are moved away from apertures 116, 122, with a single pill P remaining positioned for exit therethrough.

In a step S104, the user continues rotation of cap 120 such that aperture 122 of cap 120 aligns with aperture 116 of neck 114. Upon such alignment, in a step S105, a single pill P is provided a substantially unrestricted passage to exit dispenser apparatus 100, for example, into the palm of a user or onto a surface such as a table surface for later retrieval by the user.

In embodiments, aperture 122 may be larger than aperture 116 on neck 114. In this regard, a generic cap 120 may be paired with containers 110 with apertures 116 of variable size, as long as apertures 116 are as large as or smaller than aperture 122. Alternatively, the aperture 116 on neck 114 may be larger than the aperture 122 on the cap 120 to enable a generic container 110 to be used and an appropriate cap 120 to be selected to uniformly disperse pills of a specific size. Either arrangement may be desirable, for example, to streamline manufacturing efforts.

The position of lock 118 on neck 114 relative to the position of aperture 116 may facilitate the locking and dispensing operations of dispenser apparatus 100 described above. While lock 118 and aperture 116 are shown disposed about 90 degrees relative to one another, other relative positions for these components may be used, for example, 45 degrees, 135 degrees, or 180 degrees, to name a few. In embodiments, container 110 and cap 120 may be configured such that cap 120 may be rotated along a predetermined range with respect to container 110. In embodiments, cap 120 may include one or more additional openings such that aperture 122 may need not be used for alignment and/or engagement with both the lock 118 and aperture 116.

In embodiments, additional features may be provided with lock 118 to facilitate operation of container 110. For example, one or more stops may be provided on an interior surface of cap 120 such that lock 118 may inhibit rotation of cap 120 beyond a predetermined range. Such a configuration may be used to allow a limited range of rotation for cap 120, for example, to avoid confusion of a user or to prevent disassembly of cap 120 from container 110.

Figure 5A:
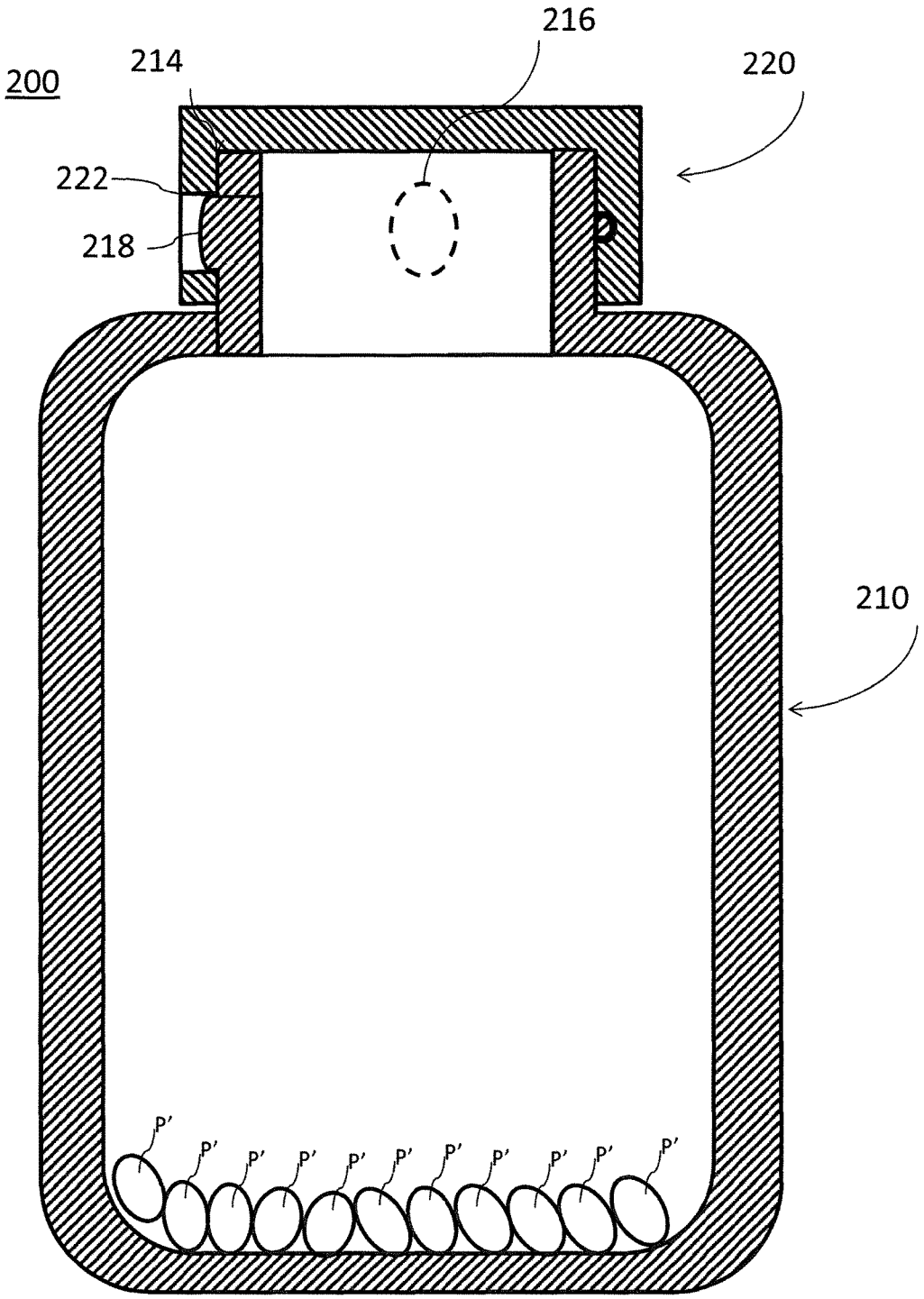
FIG. 5A is a first sequential cross-sectional view of a dispenser apparatus according to another exemplary embodiment of the present invention.
Figure 5B:
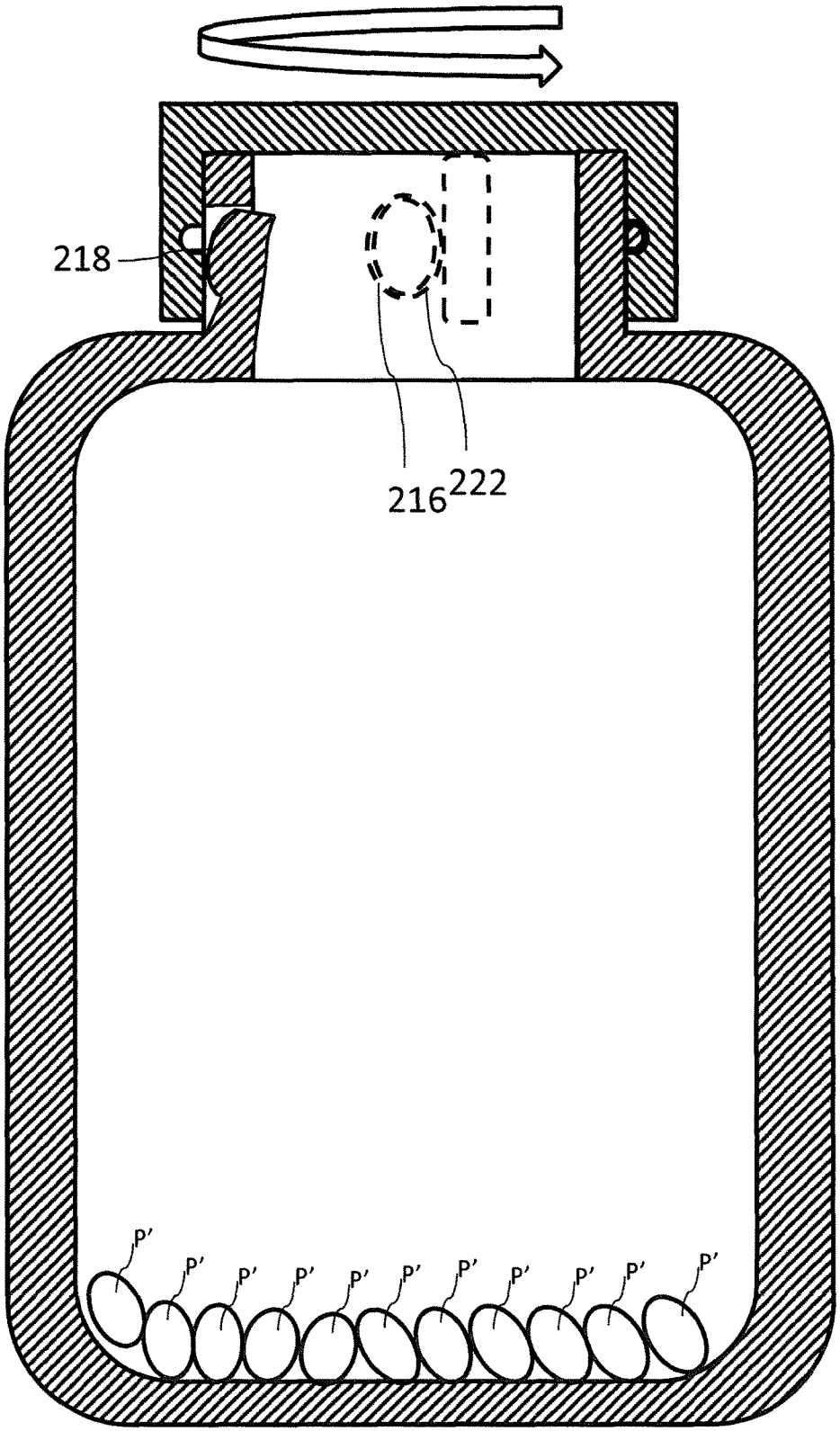
FIG. 5B is a second sequential cross-sectional view of a dispenser apparatus according to another exemplary embodiment of the present invention.

Referring to FIGS. 5A and 5B, another embodiment of a dispenser apparatus is generally designated 200. Dispenser apparatus 200 may have substantially similar components to dispenser apparatus 100 described above, and may include a neck aperture 216 and a cap aperture 222 that align to allow the dispensation of pills of a different shape and/or size than pills P described above. As shown, ovular cap aperture 222 rotationally aligns with ovular neck aperture 216 on a neck 214 of container 210 so that dispenser apparatus 200 is configured to retain and dispense pills P' having an ovular configuration. In embodiments, a dispenser apparatus 200 may be provided with openings to facilitate the dispensation of a different type of pill, for example, a square or rectangular pill, a pentagonal pill, a hexagonal pill, a spherical pill, or an octagonal pill, to name a few.

Figure 7:
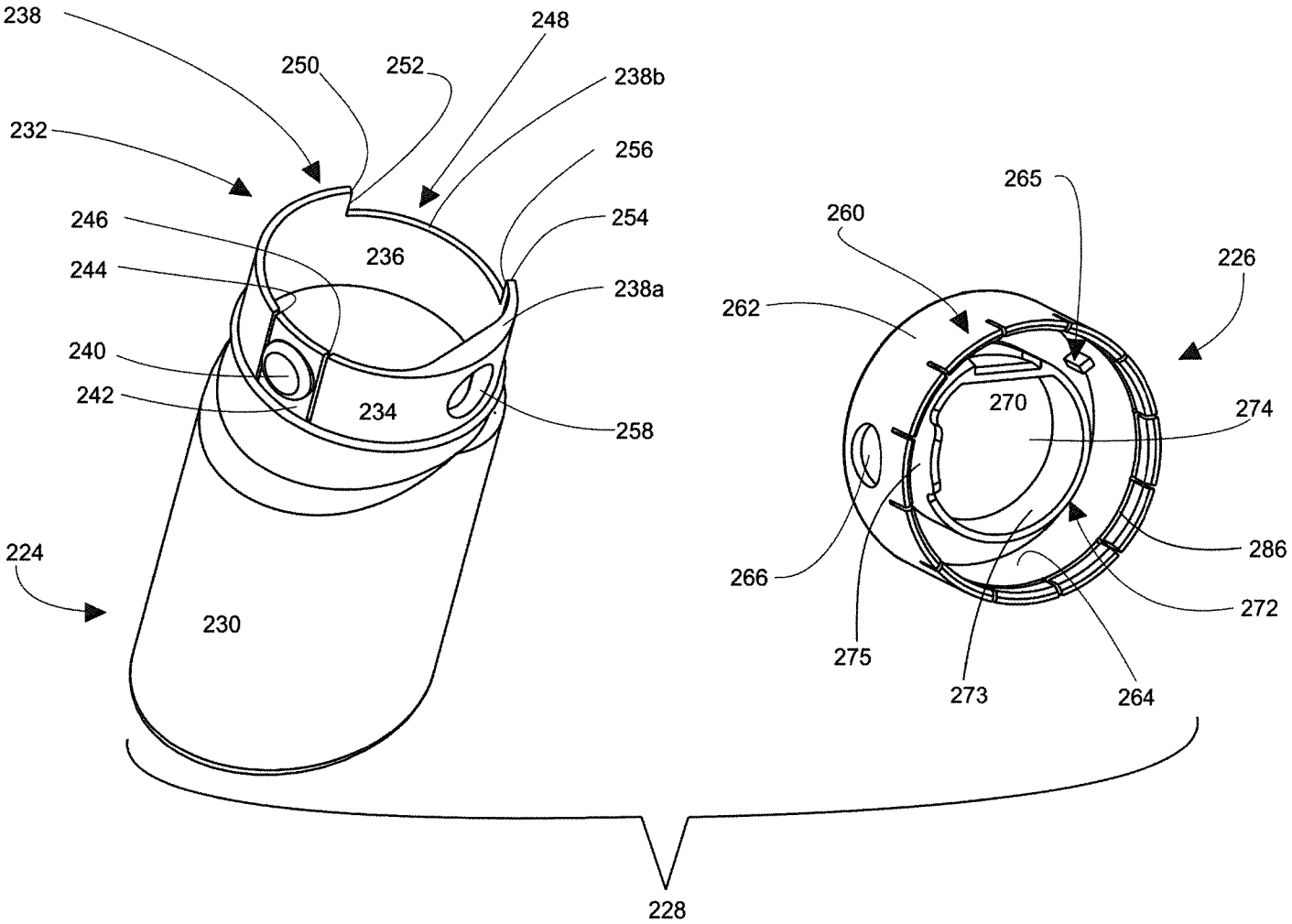
FIG. 7 is an exploded view of a dispenser apparatus according to an exemplary embodiment of the present invention.

In other embodiments of the invention, a pill dispenser is formed of a pill container and a cooperating cap having a compartment that is configured to receive a single pill to be dispensed through an aperture. For example, FIG. 7 shows a side perspective view of a container 224 and a bottom perspective view of a cooperating cap 226, which form a pill dispenser 228 according to embodiments of the invention. Container 224 is formed of walls 230 having outer surfaces and inside surfaces which form a pill storage cavity. It will be understood that the shape of container 224 may vary in different embodiments of the invention. For example, in the exemplary embodiment shown in FIG. 7, upper ends of container walls 230 slope inwardly and terminate in a substantially circular neck 232.

As shown, neck 232 is a substantially rounded collar formed of walls that extend upwardly from container walls 230. Walls of neck 232 have an outer surface 234, an inner surface 236 and a lip 238. In embodiments of the invention, a button 240 which functions as a cap lock, is positioned on the outer surface 234 of neck 232. It will be understood that any projection extending from the outer surface 234 of neck 232 that is at least partially insertable into a cooperating aperture 266 on a cap annular edge 260 may serve as a cap lock in embodiments of the invention.

Still referring to FIG. 7, in an embodiment of the invention, button 240 is positioned on a panel 242 that is separated from the rest of the neck 234 by way of substantially parallel notches, scores, or similar fault points in neck 232. For example, as shown, a first cut 244 made through the height of neck 232 and a substantially parallel second cut 246 made through the height of neck 232 forms a panel 242 that is connected only at its lower end to container walls 230. As a result, panel 242 pivots independently in a first lateral direction toward the center of the container when force is applied thereto (e.g. by a user pressing against button 240 to disengage the lock)—and it moves in a second lateral direction away from the center of the container 224 when such force is removed.

In embodiments of the invention, a notch or similar recess 248 is formed in an upper segment of neck 232. As shown, recess 248 is a stepped down segment of lip 238 spanning an approximate 90° area around the neck 232. As shown, at a first position 250, lip turns downwardly (i.e. toward container 224) at a substantial right angle forming first wall 252. Similarly, at a second position 254, lip turns downwardly at a substantial right angle forming second wall 256. Thus, lip 238 has an upper lip area 238*a* and a lower lip area 238*b* that spans the distance between first wall 252 and second wall 256. In an embodiment of the invention the midpoint between first and second walls 252, 256 is substantially in diametric opposition to the center of button 240.

As shown, in embodiments of the invention, an aperture 258 made through the neck 232 allows for egress of pills from pill dispenser 228.

As shown, in embodiments of the invention, cap 226 is formed of a substantially circular roof plate, surrounded by an annular edge 260 extending downwardly therefrom. Annular edge 260 has an outside surface 262 configured to be grasped by a user and an inside surface 264 that is sized and shaped to capture neck 232 in a tight relationship. Annular edge 260 has an aperture 266 that may be similarly sized and shaped to aperture 258 of neck 232 and is positioned to substantially align with aperture 258 on neck 232 when cap 226 is rotated to a dispensing position.

Roof plate has an upper surface 268 (shown e.g. in FIG. 8) and an underside surface 270 (shown in FIG. 7). Underside surface 270 of roof plate and the inside surfaces 264 of annular edge 260 form a cavity on the underside of cap 226.

Figure 12:
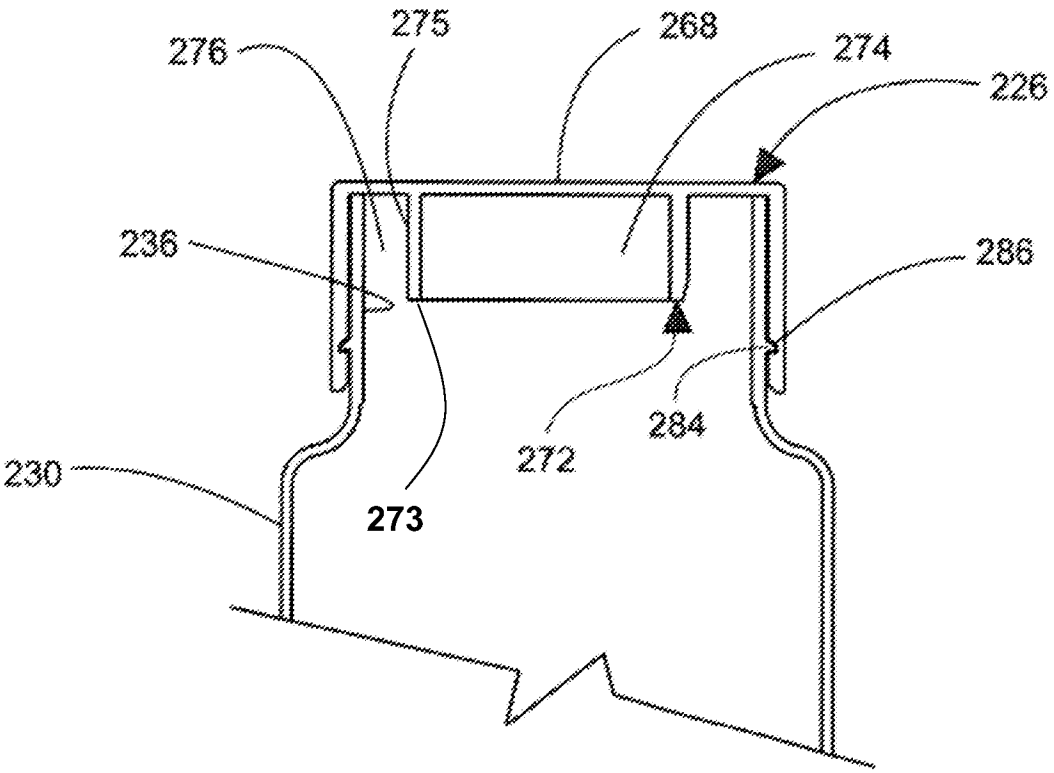
FIG. 12 is a partial schematic front cross-sectional view of pill dispenser apparatus according to an exemplary embodiment of the invention.

As shown in FIGS. 7 and 12, in embodiments of the invention, a roof wall 272 extends downwardly from underside surface 270 of roof plate to terminate in a roof wall nadir 273. In an embodiment of the invention, roof wall 272 is a substantially circular wall that emanates from underside surface 270 of roof plate and may terminate within the cavity of cap 226. Roof wall 272 has an inside surface 273 and an outside surface 275. In embodiments, of the invention, roof wall 272 is diametrically smaller than lip 238 and may be shorter than annular edge 260.

Roof wall 272, thus, forms a central chamber 274 in the cap space surrounded by inside surface 273 of wall 272. In addition, when cap 226 is seated on a neck 232 of a cooperating container 224, a peripheral chamber 276 is formed in the space between the outer surface 275 of roof wall 272 and the inner surface 236 of neck 232 (e.g. as shown in FIG. 12). It will be understood that, in embodiments of the invention, roof wall 272 may only have an outside surface 275 forming only a peripheral chamber 276. For example, roof wall 272 may have an outer wall and a solid interior—forming a disk-like structure.

Also shown in FIG. 7, a stop 265 extends downward from underside surface 270 of the roof plate. In embodiments of the invention, stop 265 is integrally formed having one surface that contacts underside surface 270 of the roof plate and another surface that contacts inside surface 264 of annular edge 260. In other embodiments of the invention, stop 265 may extend only from the inside surface 264 of annular edge 260 or only from the underside surface 270 of the roof plate. A first side surface of stop 265 is configured to contact first wall 252 when cap 226 is rotated in a first direction and a second side surface of stop 265 is configured to contact second wall 256 when cap 226 is rotated in a second direction.

In embodiments of the invention, the width of peripheral chamber 276 (i.e. distance between the outer surface 275 of roof wall 272 and inner surface 236 of neck 232) is smaller than the thickness of respective pills to be stored in the dispenser 228. As such, stored pills may enter central chamber 274 but are prevented from entering the peripheral chamber 276 because of the width restriction described.

In embodiments of the invention, a singular pill-receiving compartment 278 (best shown in FIG. 9) is formed contiguously with peripheral chamber 276 that is adapted to receive one individual pill to be dispensed.

Figure 8:
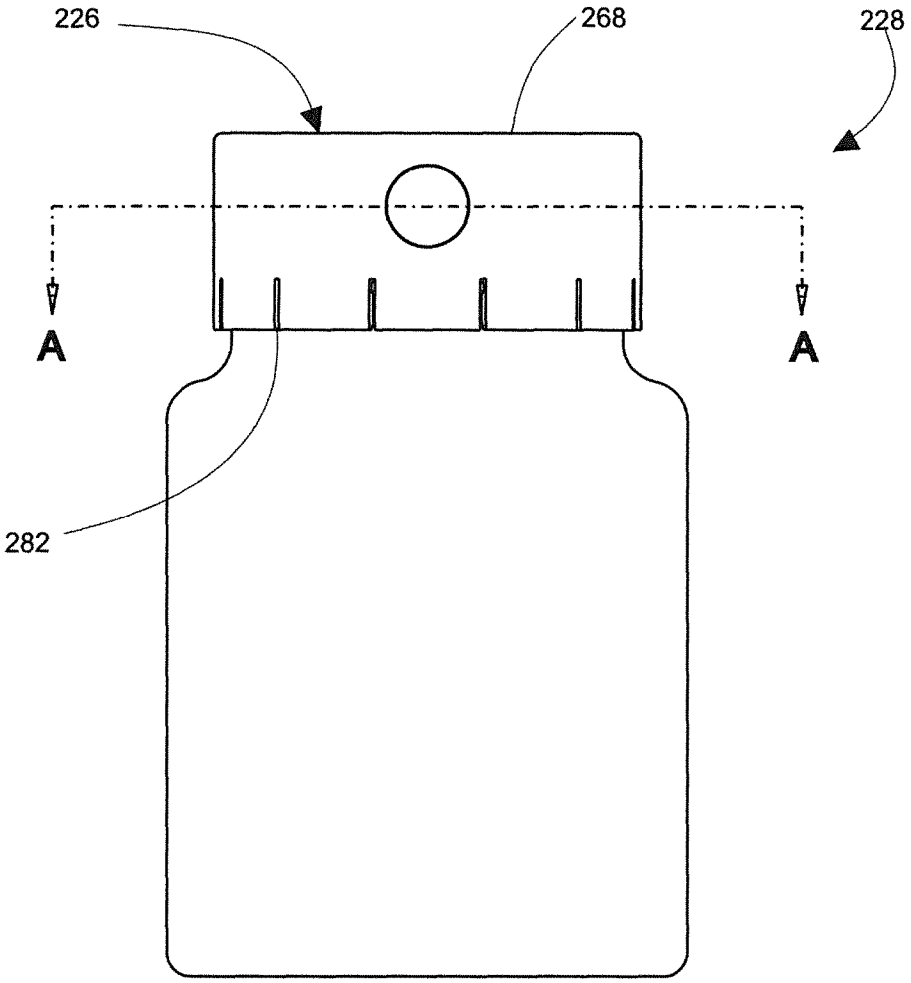
FIG. 8 is a front view of the dispenser apparatus of FIG. 7, shown assembled according to an exemplary embodiment of the present invention.

FIG. 8 shows a front view of a pill dispenser with cap 226 seated on neck 232 and rotated to a dispensing position.

Figure 9:
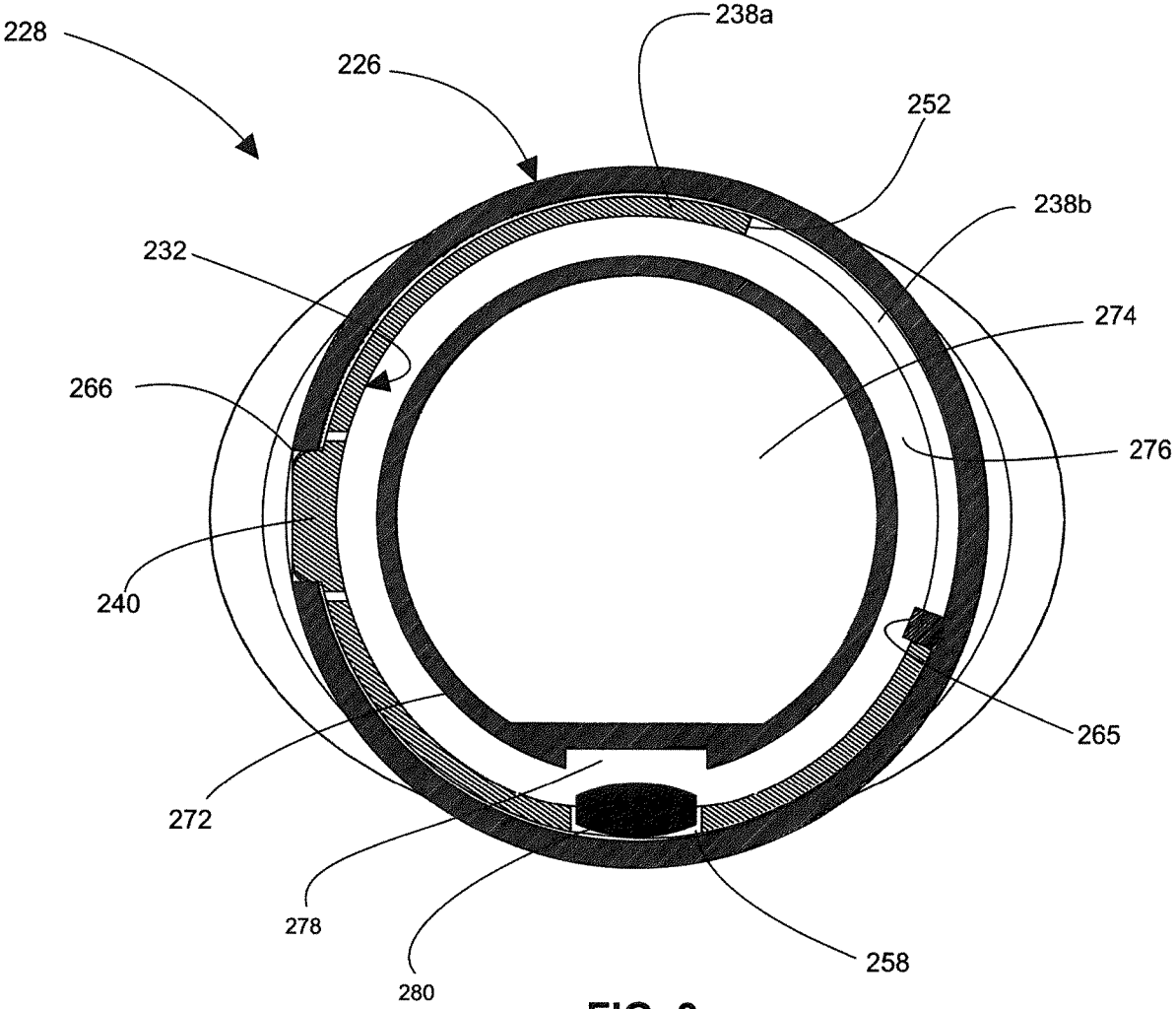
FIG. 9 is a top cross-sectional view taken through plane "A-A" of the dispenser apparatus of FIG. 8 where the cap is rotated to a locked position in an exemplary embodiment of the invention.

FIG. 9 shows a top cross-sectional view taken through plane "A-A" of the pill dispenser 228 of FIG. 8, except that cap 226 is shown in a locked/loading position. That is, as shown, button 240 on neck 232 is inserted through aperture 266 (at approximately 9:00 in the orientation shown) preventing rotation of cap 226 with respect to neck 232. As shown, (at approximately 6:00), an indentation is formed in roof wall 272 creating a pill loading compartment 278 contiguously with peripheral chamber 276 that is sized and shaped to receive a single pill 280. It will be understood that pill loading chamber 278 may be formed by providing a notch, recess or such similar indentation in a given segment of outside surface 275 of roof wall 272, such that the distance between the given segment of roof wall 272 and the inner surface 236 of neck 232 is greater than the width of peripheral chamber 276.

In an exemplary embodiment of the invention, the width of pill loading chamber 278 is greater than the thickness of respective pills to be dispensed by dispenser 228 such that a pill to be dispensed may enter therein. Moreover, in embodiments of the invention, pill loading chamber 278 is sized and shaped to receive only a single pill. As shown in FIG. 9, a single pill 280 is loaded into the pill loading compartment 278. With a pill so positioned, a user disengages the lock and rotates the cap 226 a sufficient distance to cause annular edge aperture 266 to align with neck aperture 258. In embodiments of the invention, cap 226 rotates approximately 90° between the locked/loading position (where aperture 266 is substantially aligned with button 240) and the dispensing position (where aperture 226 is substantially aligned with neck aperture 258) and vice versa, but it will be understood by those of ordinary skill in the art that cap 226 may be configured to rotate more or less than 90° in embodiments of the invention.

Figure 10:
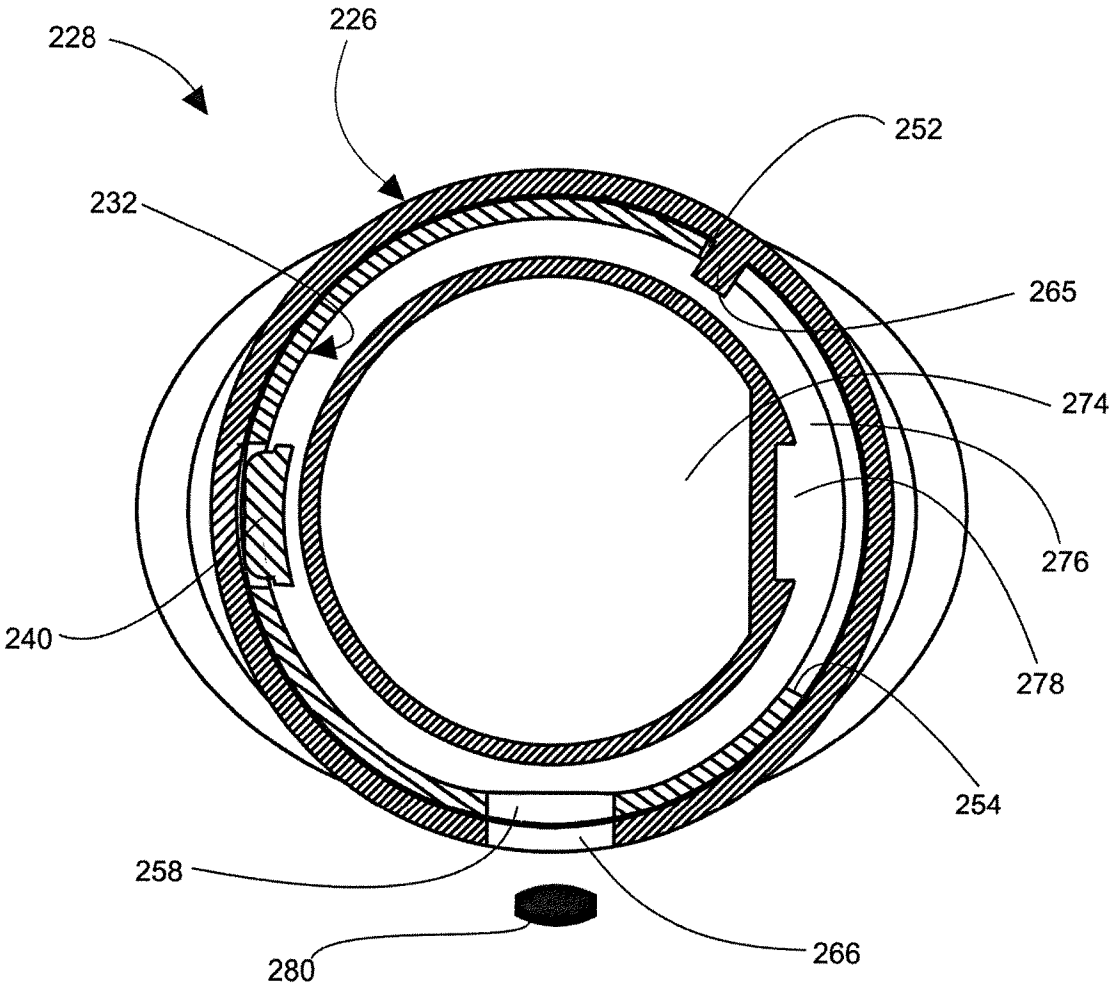
FIG. 10 is a top cross-sectional view taken through plane "A-A" of the dispenser apparatus of FIG. 8 in an exemplary embodiment of the invention.

For example, FIG. 10 shows the cap 226 of dispenser 228 rotated to a dispensing position. In the orientation shown, cap 226 is rotated around 90° in a counterclockwise direction (with respect to the position shown in FIG. 9) to allow annular edge aperture 266 to align with neck aperture 258.

Figure 11:
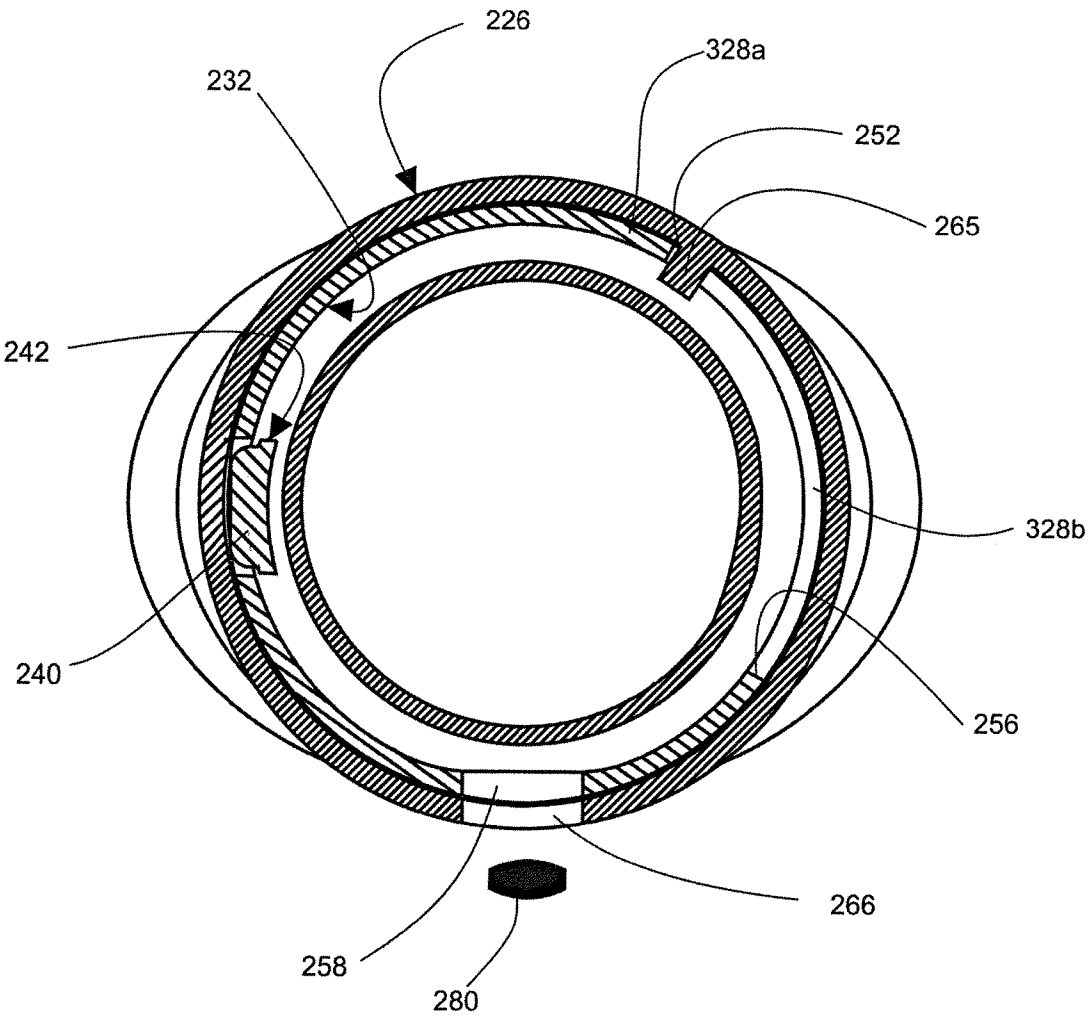
FIG. 11 is a top cross-section view taken through plane "A-A" of the dispenser apparatus of FIG. 8 in an exemplary embodiment of the invention.

In other embodiments of the invention, and as shown in FIG. 11, no recess is provided in the outer surface of roof wall 272. In such embodiment, a pill receiving chamber is formed by the space defined by neck aperture 258 and the cap cavity area adjacent thereto. That is, because there is no neck wall in the area defined by aperture 258—there is an enlarged area that spans from the outer surface 275 of roof wall 272, through aperture 258 and terminates in the inside surface 264 of annular edge 260 (which covers aperture 258 in locked position). Consequently, the distance between outer surface 275 of roof wall 272 to the inside surface 264 of annular edge 260 is greater than the width of peripheral chamber 276. In embodiments of the invention, this enlarged area is a pill loading compartment that is sized and shaped to receive a single pill. In embodiments of the invention, pills stored in the container 224 are prevented from entering into peripheral chamber 276. However, a single pill may insert into the pill loading compartment substantially adjacent to neck aperture 258.

In embodiments of the invention, when cap 226 is in a locked position, pill loading compartment 278 substantially aligns with aperture 258 in neck 232.

In use, a user tilts or inverts pill dispenser 228 to cause a plurality of pills to enter the cavity of cap 226. Pills may freely accumulate inside of central chamber 274, but they will be prevented from entering peripheral chamber as described. One pill (e.g. 280), however, may enter into pill chamber 278. In embodiments of the invention, because pill loading compartment 278 is aligned and is substantially contiguous with neck aperture 258, pill 280 will, at least partially, insert into the confines of aperture 258. Once a pill is lodged within aperture 258, a user presses button 240 inward to disengage the lock and then rotates the cap 226 in a first direction (e.g. counterclockwise in the orientation shown). Pill 280 remains lodged within aperture 258 during rotation of cap 226 and outer surface 275 of roof wall 272 serves as a continuous barrier maintaining pill 280 in position. After about 90 degrees of rotation, first side of stop 265 contacts wall 252 preventing further rotation in the counterclockwise direction. In such position, respective apertures 258, 266 become aligned—forming an egress port for pill 280 to exit from pill dispenser 228.

FIGS. 10 and 11 which show top cross-sectional views of pill dispensers of the present invention where cap 226 is rotated to a dispensing position. As shown, stop 265 is in contact with wall 252, thereby preventing further rotation of cap 226 in the counterclockwise direction. In this position, respective apertures 258, 266 are aligned to form a channel to the inside of the dispenser. Pill 280 is shown having moved from the pill loading compartment 278 to the outside of dispenser 228. Panel 242 with associated button 240 is shown pivoted inwardly and maintained as such by the inside surface 264 of annular edge.

Once a pill is dispensed, a user rotates the cap 226 in a second direction that (e.g. clockwise in the orientation shown) to return the dispenser to a locked position. In embodiments of the invention, cap 226 is rotated substantially 90° until second surface of stop 265 bears against second wall 256 and the aperture 266 in annular edge 260 becomes aligned to receive button 240 therein.

In embodiments of the invention, cap 26 is rotatably affixed to neck 232 by way of a track or similar engagement mechanism that allows rotation of cap 226 solely within a horizontal plane. For example, with reference to FIG. 12, a bead 284 or similar protrusion extends from the surface of outer surface 234 of neck 232. In embodiments of the invention, bead 284 is a protruding area forming a track around the entire perimeter of the outer surface 234 of neck 232. A circumferential channel or groove 286 is formed at a lower segment of the inside surface 264 of annular edge 260 of cap 226 that is sized and shaped to receive bead 284. In embodiments of the invention circumferential groove 286 is substantially a negative shape of bead 284. It will be understood that in embodiments of the invention, a bead may be formed on the inside surface of a annular edge 260 and a cooperating circumferential groove may be formed on the outer surface 234 of neck 232.

In embodiments of the invention, bead 284 and circumferential groove 286 align such that bead 284 at least partially inserts into circumferential groove when cap 226 is seated on neck 232. This allows for the rotation of cap 226 with respect to container 224, but prevents upward and/or downward movement thereof.

With reference to FIG. 8, which shows a front view of pill dispenser 228, lower end of cap 226 is shown having a series of substantially parallel notches 282, each of which start at bottom of annular edge 260 and extend upwardly through a segment of annular edge 260. In embodiments of the invention, notches 282 begin at the bottom of annular edge 260 and terminate at or proximate to circumferential groove 286. Notches 282 form fault points that collectively allow for a slight expansion of the lower segment of annular edge 260.

Thus, during assembly of pill dispenser 228, cap 226 is forcefully applied over neck 232 such that annular edge sections disposed between notches 282 temporarily pivot laterally away from the center of container 224 when cap 226 is passed over protruding bead 284. Once cap 226 is fully installed, bead 284 inserts into circumferential groove 286, thereby securing cap 226 to container 224.

While this invention has been described in conjunction with the embodiments outlined above, it is evident that many alternatives, modifications and variations will be apparent to those skilled in the art. For example, the components of the dispenser apparatuses disclosed herein may be at least partially formed of materials such as polymeric materials and/or composite materials. Accordingly, the exemplary embodiments of the invention, as set forth above, are intended to be illustrative, not limiting. Various changes may be made without departing from the spirit and scope of the invention.

The invention claimed is:

1. A pill dispenser for dispensing a pill, said dispenser comprising:

a container defining an interior cavity for storing pills to be dispensed terminating in an upper neck comprising a sidewall having a neck pill outlet through-aperture spanning less than half of a neck circumference; and a cap comprising a cap top bearing a downwardly protruding peripheral cap wall, adapted to rotate about, and in close proximity to, an exterior of said container neck and a downwardly protruding central wall abutting a central cap chamber and wholly circumscribed within said peripheral cap wall; wherein said peripheral cap wall includes a cap pill outlet through-aperture; and wherein said central wall includes an outer surface bearing a latitudinally-recessed, pill cavity, spanning less than half of a cap circumference, longitudinally spanning to a nadir of said central wall, said pill cavity offset from said pill aperture, wherein said cap is adapted to occupy at least two positions about said neck: (i) a load position characterized by said neck pill outlet through-aperture being aligned with said cap pill cavity; and a (ii) dispense position, occupied subsequent to said pill load position, characterized by said cap pill outlet through-aperture being aligned with said neck pill outlet through-aperture.

2. The dispenser of claim 1 further comprising exterior indicia on said cap and said container indicating alignment in said load position.

3. The dispenser of claim 2 wherein said exterior indicia includes a protrusion fitting within said cap pill outlet through-aperture.

4. The dispenser of claim 3 wherein said protrusion is dimensioned to form a cross-sectional close fit with said cap pill outlet through-aperture to permit selective axial rotation and restriction between said cap and said neck.

* * * * *